US006228244B1

(12) United States Patent
Lido et al.

(10) Patent No.: US 6,228,244 B1
(45) Date of Patent: May 8, 2001

(54) CHROMIUM PLATING FROM BATHS CATALYZED WITH ALKANEDISULFONIC-ALKANESULFONIC COMPOUNDS WITH INHIBITORS SUCH AS AMINEALKANESULFONIC AND HETEROCYCLIC BASES

(75) Inventors: Frediani Lido, Novara; Giovanni Merello, Pegli, both of (IT)

(73) Assignee: Luigi Stoppani S.p.A., Milan (IT)

( * ) Notice: Subject to any disclaimer, the term of this patent is extended or adjusted under 35 U.S.C. 154(b) by 0 days.

(21) Appl. No.: 09/171,143

(22) PCT Filed: Feb. 11, 1998

(86) PCT No.: PCT/EP98/00762

§ 371 Date: Dec. 18, 1998

§ 102(e) Date: Dec. 18, 1998

(87) PCT Pub. No.: WO98/36108

PCT Pub. Date: Aug. 20, 1998

(30) Foreign Application Priority Data

| | | |
|---|---|---|
| Feb. 12, 1997 | (EP) | 97830050 |
| May 15, 1997 | (EP) | 97107909 |
| Jun. 10, 1997 | (EP) | 97109366 |

(51) Int. Cl.[7] ..... C25D 3/10
(52) U.S. Cl. ..... 205/290; 205/284
(58) Field of Search ..... 205/283, 284, 205/285, 290

(56) References Cited

U.S. PATENT DOCUMENTS

| | | | | |
|---|---|---|---|---|
| 4,093,522 | * | 6/1978 | Dillenberg | 205/290 |
| 4,588,481 | * | 5/1986 | Chessin et al. | 205/209 |
| 4,810,336 | * | 3/1989 | Martyak | 205/290 |

FOREIGN PATENT DOCUMENTS

| | | |
|---|---|---|
| 523 968 | 7/1972 | (CH) . |
| WO 98/36108 | 8/1998 | (WO) . |

* cited by examiner

*Primary Examiner*—Kathryn Gorgos
*Assistant Examiner*—William T. Leader
(74) *Attorney, Agent, or Firm*—Cobrin & Gittes

(57) ABSTRACT

C1–C12 Alkanesulfonic or Alkanedisulfonic compounds and Aminoalkanesulfonic acids or salts thereof, are used as additives in chromium plating baths to reduce anodic corrosion, improve the covering and penetrating power of the bath, reduce the surface-tension and give a bright deposit.

15 Claims, 1 Drawing Sheet

FIG. 1
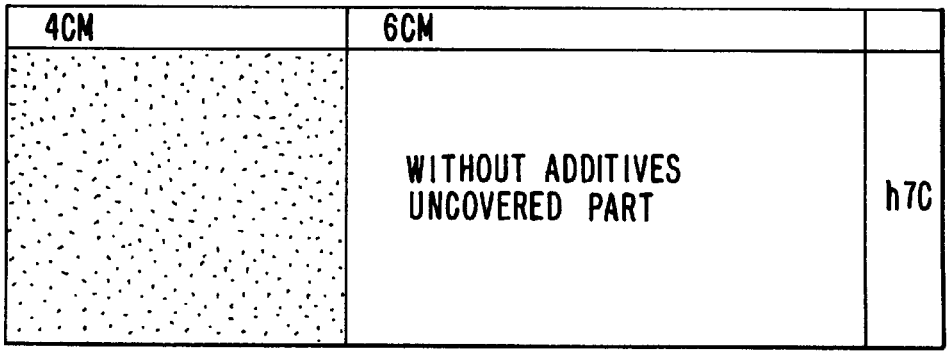
FIG. 2
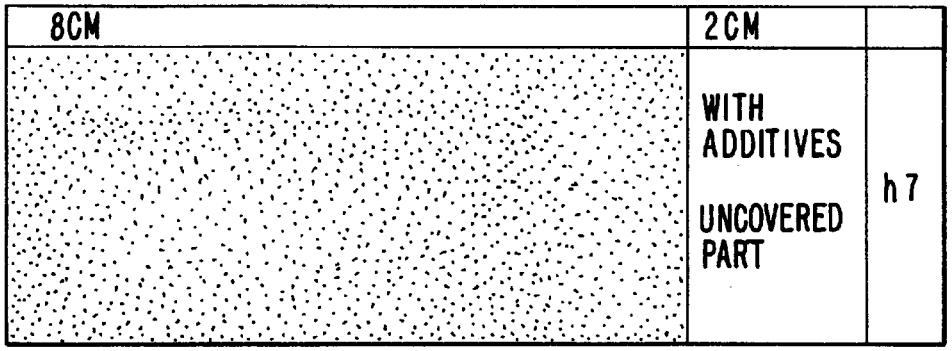
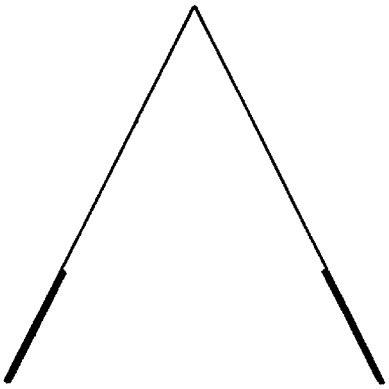
FIG. 3
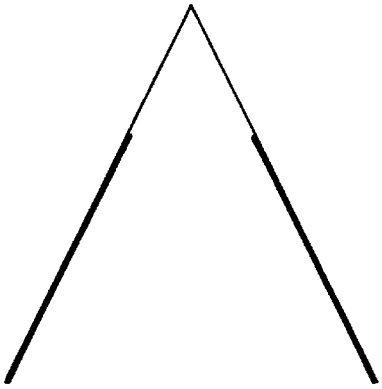
FIG. 4

CHROMIUM PLATING FROM BATHS CATALYZED WITH ALKANEDISULFONIC-ALKANESULFONIC COMPOUNDS WITH INHIBITORS SUCH AS AMINEALKANESULFONIC AND HETEROCYCLIC BASES

TECHNICAL FIELD

The present invention relates to chromium plating baths with organic additives, resistant in solutions of chromium, to obtain electrodeposition of penetrating and covering chromium while avoiding anodic corrosion.

BACKGROUND OF THE INVENTION

Alkane sulfonic and disulfonic acids were first used as additives for electrolytic baths in 1930, at the Politecnico of Milan. After the Second World War American, French, German, Polish and Soviet researchers reported and claimed disulfonic acids and their salts as improvers of cathode efficiency in chromium plating baths. However, application of these types of baths on a large scale over a period of time revealed inferior properties compared to traditional baths, in that they cause accelerated corrosion of the anode (an alloy of lead).

The mechanism that leads to these drawbacks is described as follows:

Acidic dissolution of $PbO_2$ due to the polarization of acid concentration:

$PbO_2+2H^+=PbO^{2+}+H_2O$

Reaction of the lead oxide favored by the excess of acidity with $H_2O_2$ formed at the anode $PbO_2+H_2O_2+2H^+=Pb^{2+}+O_2+2H_2O$ (the reformation and the stabirization of the $PbO_2$ is, on the contrary, favored by a deficit of free acid: $Pb^{2+}+O_2+H_2O=PbO_2+H_2O_2+2H^+$).

The anode degradation rate is further increased by the fact that the $Pb^{2+}$ ions formed are removed from the equilibrium by the formation of stable complexes with ions in solution—for instance traces of halides and degradation products of the organic acids. Many proposals have been suggested to eliminate the drawbacks described above, by chemical and electrical means, but with unsatisfactory results.

DISCLOSURE OF THE INVENTION

This patent claims the use of certain additives in specific concentrations, to improve the covering and penetration power of the chromium plating baths while avoiding anodic corrosion.

Anodic corrosion can be drastically reduced or eliminated by adding appropriate concentrations of aminoalkanesulfonic compounds or heterocyclic nitrogen containing bases to the chromium plating baths containing Alkanedisulfonic or Alkanesulfonic acids or salts.

These substances in elevated concentrations can lead to a cathode efficiency below that of a traditional chromium plating both.

a) The aminoalkanesulfonic and the heterocyclic bases are added to the chromium plating baths containing Alkanedisulfonic and Alkanesulfonic acids and salts, in such concentrations as to give a Faraday output of 15–16% constant (not of interest in this patent which claims other parameters).

b) The corrosion inhibitors, chemical compounds, added to the chromic solutions containing Alkanesulfonic and Alkanedisulfonic acids and salts, drastically reduce the corrosion rate of anodes immersed in them, shifting the corrosion potential to values nobler than the primary potential, or increasing the overload of the anodic or cathode process or of both simultaneously according to their chemical nature.

Such purpose is achieved by the present invention, which relates to chromium plating baths comprising one or more compounds selected from compounds having general formula:

$$X—(CH_2)_n—SO_3H \quad [1]$$

where:

n=integer from 1 to 12

$X=NH_2$ and salts thereof, and nitrogen containing heterocyclic bases and/or their complexes with $CrO_3$.

Preferred compounds of formula [1] are aminoalkanesulfonic acids and salts $C_2$–$C_6$ and most preferably $C_2$ and $C_3$ compounds. Preferably, nitrogen containing heterocyclic bases are provided as complexes with chromium, namely with $CrO_3$. An example of such complexes is the complex between pyridine and $CrO_3$, as shown by the following formula:

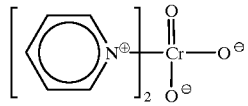

Further preferred complexes are those of pyridine homologues, optionally with ring substituents, such as e.g. nicotinic acid, picolinic acid, 4-pyridinethanesulfonic acid, etc.

In presence of these compounds the anodic corrosion is drastically reduced even in the presence of high concentrations of compounds of general formula:

$$Y—(CH_2)_n—SO_3H \quad [2]$$

where:

n=integer from 1 to 12

Y=H or $SO_3H$;

and salts thereof.

These additives are employed in chromium plating baths, in combination with the previously disclosed compounds in order to give penetrating and covering chromium deposits without corrosion of the lead alloy anode.

The additives object of the invention are provided within the range of 0.1–40 g/l, preferably within 1–20 g/l, more preferably 1–10 g/l, and most preferably within the range of 2–3 g/l.

Another object of the invention is a concentrated formulation containing $CrO_3$ and one or more additives of formula [1], and/or one or more nitrogen containing heterocyclic bases and their complexes with chromium, and/or compounds of formula [2] for the preparation of chromium plating baths.

Further objects of the invention are the uses of the compounds of formula [1] and [2], including nitrogen containing heterocyclic bases and chromium complexes thereof.

A further advantage of the present invention is given by the fact that the addition to a chromium plating bath of compounds of general formula [1] and [2] with 6–12 atoms of carbon, leads to a reduction of the surface tension of the bath with the advantage of eliminating splashing, reducing the losses to transport with notable saving of chromic acid, so much so that their employment is cost-reducing and improves the work environment (TLV-TWA values).

Penetrating power is a grading of the metal as a function of the electric current, where chromium plating baths have scarce penetrating power.

Various methods for the measurement of the penetrating power of the electrolytic baths exist as for instance:

a) the technique of E. Haring and W. Blum;

b) Method of C. Pam.

BEST MODE FOR CARRYING OUT THE INVENTION

The invention will now be disclosed by way of non-limitative reference to the following examples and to the enclosed drawings, where:

FIG. 1 is the schematic representation of a test-plate of the penetrating power of a traditional bath;

FIG. 2 is the schematic representation of a test-plate of the penetrating power of a traditional both in the presence of additives; and FIGS. 3 and 4 are a schematic representation of the covering power of a V-shaped plate.

We have established the penetrating power of the chromium plating bath through a Hull cell. For this purpose it is sufficient to observe the presence and degree of deposition of chromium which is obtained on the test-plates in zones of least density of current.

EXAMPLE 1

A chromium plating both of the traditional type was prepared:

250 gr/lt $CrO_3$ 2.5 gr/lt $H_2SO_4$

The chromium was deposited in Hull cell, for 8' on an iron cathode of length of 10 cm, at a temperature of 60° C. with current of 10 Amp.

The bare part was 6 cm.

EXAMPLE 2

The test was repeated, in similar conditions to Example 1, in the presence of non-limiting additives:

250 g/lt $CrO_3$ 2.5 g/lt $H_2SO_4$ 6 g/lt Ethanedisulfonic sodium salt 1 g/lt Aminoethanesulfonic acid The bare part was 2 cm.

Covering power of a chromium plating both is the minimum current at which the chromium deposit begins to form.

EXAMPLE 3

A chromium bath of the traditional type was prepared:

250 g/lt $CrO_3$ 2.5 g/lt $H_2SO_4$

The cathode used was a V-shaped panel. Temperature was 60° C.

The chromium was deposited on the cathode for 8' with a current of 10 Amp.

The part not electroplated was 6 cm. (FIG. 3).

EXAMPLE 4

The test is repeated with a catalyzed chromium plating bath in the following concentrations:

250 g/lt $CrO_3$ 2.5 g/lt $H_2SO_4$ 6 g/lt Ethanedisulfonic sodium salt 1 g/lt Aminoethanesulfonic The part not electroplated was 3 cm. (FIG. 4).

The chromium plating baths were re-tested in the presence of nitrogen containing heterocyclic base-type inhibitors; the results were similar to the preceding examples.

FIG. 3 is a scheme of "V"-shaped cathode after deposition in a traditional bath for evaluation of the covering power.

FIG. 4 is an analogous scheme to that of FIG. 3 after deposition in a bath containing the additives according to the invention.

The salts of the alkyldisulfonic acid can be prepared by reaction of an Alkyl dihalide with a sulphite, through a nucleophilic substitution reaction with the halogens, the leaving groups, that are replaced by $SO_3$ groups.

The alkyl dihalides that can be employed in this process have general formula:

$$C_nH_{2n}X_2$$

where n=integer from 1 to 12

X=Cl, Br, I e.g. 1,2-dibromoethane, 1,3-dibromopropane, 1-chloro-3-bromopropane etc.

The reactivity order is I>Br>Cl; the more convenient compounds are the Alkyl dibromides, e.g. 1–2 dibromoethane—a good compromise between reagent cost and reactivity.

Water-soluble sulphites e.g. $Na_2SO_3$, $K_2SO_3$, $(NH_4)_2SO_3$, $ZnSO_3$, $MgSO_3$ etc. can be used as reactive sulphites, or the corresponding soluble metabisulphite could be used, treated with an equimolar quantity of the corresponding hydroxide.

Water or $H_2O$-ethanol, $H_2O$-methanol mixtures can be used as solvents. The reaction proceeds very slowly at ambient temperature and T>80° C. is preferable to give an acceptable reaction.

The reaction can be represented by the following general equation $$C_nH_{2n}X_2+2\ Me_2SO_3 \rightarrow C_nH_{2n}(SO_3Me)_2+2\ MeX$$

where n=number from 1 to 12, X=Cl, Br, I.

The reaction must take place with sulphite in excess of the stoichiometric quantity to guarantee the maximum yield of alkyldisulphonate and minimize the secondary reactions of hydrolysis of the halide, with formation of glycols and hydroxyalkylsulphonates.

The reaction can be performed with a sulphite: dibromoethane molar ratio of from 1.1/1 to 1.5/1.

EXAMPLE 5 (not limiting)

A solution formed of:

376 g. $Na_2SO_3$ 1 liter $H_2O$ is placed in a 2 liter reactor provided with refrigerant, thermometer, stirrer and dripfunnel.

This solution is heated to a temperature of 80° C.; thereafter, 200 g of dibromoethane was added over 40 minutes; the molar ratio of sulphite/dibromoethane is 1.4 compared to the stoichiometric equivalent. The reactor was left to reflux for 6 hours.

The yield of the reaction is 95%.

EXAMPLE 6

The procedure is the same as in the preceding example; the reagent proportions are the following:

161 g. $Na_2SO_3$ 100 g. dibromoethane 450 g. $H_2O$

The molar ratio sulphitel dibromoethane is 1.2 compared to the stoichiometry. The yield of the reaction is 91% of the theoretical.

The reaction product can be separated from the sodium bromide, the unreacted sulphite and the by-products by means of recrystalization in water or in aqueous-methanol.

The methodology is also similar for dihalides or Alkyl halides, but, obviously, the molar ratios must be adjusted accordingly.

What is claimed is:

1. An electrolytic chromium plating process, comprising the steps of adding at least one additive into a chromium plating bath solution, the additive being an aminoalkanesulfonic acid or salt thereof; the additive being present in a concentration from 1 to 20 g./lt., and electroplating chromium from said chromium plating bath solution.

2. An electrolytic chromium plating process according to claim 1, further comprising the step of preventing anodic corrosion by adding the additive in a concentration from 1 to 10 g./lt.

3. An electrolytic chromium plating process according to claim 1, where in the step of adding results in improving covering power.

4. An electrolytic chromium plating process according to claim 1, wherein the step of adding results in improving penetrating power.

5. A chromium plating bath, characterized by comprising one or more compounds selected from compounds of the general formula:

$$X\text{-}(CH_2)_n\text{-}SO_3H \quad [1]$$

where n=an integer from 1 to 12, $X=NH_2$ or salts thereof;

and $CrO_3$.

6. A chromium plating bath according to claim 5, further comprising a heterocyclic nitrogen-containing base and/or its complex with chromium.

7. A chromium plating bath according to claim 5, further comprising one or more compounds of general formula:

$$Y\text{-}(CH_2)_n\text{-}SO_3H$$

where:

n=an integer from 1 to 12

Y=H or SO and the salts thereof.

8. A chromium plating bath according to claim 7, further comprising a heterocyclic nitrogen-containing base and/or its complex with chromium.

9. A chromium plating bath according to claim 5 or 7, wherein said compounds are present in total concentration within the range of 1 to 20 g/lt.

10. A chromium plating bath according to claim 9, further comprising a heterocyclic nitrogen-containing base and/or its complex with chromium.

11. An electrolytic chromium plating process, comprising adding to a chromium plating bath at least one compound having the general formula:

$$X\text{-}(CH_2)_n\text{-}SO_3H \quad [1]$$

where n=an integer from 1 to 12

$X=NH_2$ or salts thereof, and electroplating chromium from said plating bath, whereby anodic corrosion is reduced or prevented.

12. A chromium plating bath according to claim 11, further comprising a heterocyclic nitrogen-containing base and/or its complex with chromium.

13. An electrolytic chromium plating process, comprising adding to a chromium plating bath at least one compound having the general formula:

$$X\text{-}(CH_2)_n\text{-}SO_3H \quad (1)$$

where n=an integer from 1 to 12

$X=NH_2$ or of the salts thereof, in combination with at least one compound of the general formula $$Y\text{-}(CH_2)_n\text{-}SO_3H \quad (2)$$

where n=an integer from 1 to 12

Y=H or $SO_3H$ or salts thereof, and electroplating chromium from said plating bath, whereby the penetrating and covering power is improved.

14. The use according to the claim 13, wherein Y is a sulfonic acid group or a salt thereof.

15. A chromium plating bath according to claim 13, further comprising a heterocyclic nitrogen-containing base and/or its complex with chromium.

* * * * *

UNITED STATES PATENT AND TRADEMARK OFFICE

CERTIFICATE OF CORRECTION

PATENT NO. : 6,228,244 B1
DATED : May 8, 2001
INVENTOR(S) : Lido Frediani and Giovanni Merello It is certified that error appears in the above-identified patent and that said Letters Patent is hereby corrected as shown below:

Title page,
Line 2, change "Lido et al." to -- Frediani et al. --.
"Inventors:" change "Frediani Lido" to -- Lido Frediani --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*